US007116064B1

(12) United States Patent
Bluem

(10) Patent No.: US 7,116,064 B1
(45) Date of Patent: Oct. 3, 2006

(54) AXISYMMETRIC EMITTANCE-COMPENSATED ELECTRON GUN

(75) Inventor: Hans Peter Bluem, Princeton, NJ (US)

(73) Assignee: Advanced Energy Systems, Inc., Medford, NY (US)

( * ) Notice: Subject to any disclaimer, the term of this patent is extended or adjusted under 35 U.S.C. 154(b) by 4 days.

(21) Appl. No.: 10/789,662

(22) Filed: Feb. 27, 2004

(51) Int. Cl.
*H05H 7/00* (2006.01)
*H05H 9/00* (2006.01)

(52) U.S. Cl. ..... 315/500; 315/505

(58) Field of Classification Search ..... 315/5.46, 315/5.47, 5.41, 500, 501, 505
See application file for complete search history.

(56) References Cited

U.S. PATENT DOCUMENTS 3,454,818 A * 7/1969 Soffer et al. ..... 315/5.41
3,769,599 A * 10/1973 Leboutet et al. ..... 315/507
5,506,473 A * 4/1996 Aucouturier et al. ..... 315/5.43
5,698,949 A * 12/1997 Lien et al. ..... 315/5.31
5,744,919 A * 4/1998 Mishin et al. ..... 315/505
6,465,957 B1 * 10/2002 Whitham et al. ..... 315/5.41

* cited by examiner

*Primary Examiner*—Tuyet Vo
*Assistant Examiner*—Minh Deiu A
(74) *Attorney, Agent, or Firm*—Fulbright & Jaworski LLP

(57) ABSTRACT

An electron gun includes a cathode, a cavity, and an energy input. The cavity resonates at a particular frequency, and the cathode generates an electron beam along its longitudinal axis when driven by resonant electromagnetic radiation of the particular frequency. The energy input introduces electromagnetic radiation of the particular frequency into the cavity along the longitudinal axis of the cathode.

19 Claims, 1 Drawing Sheet

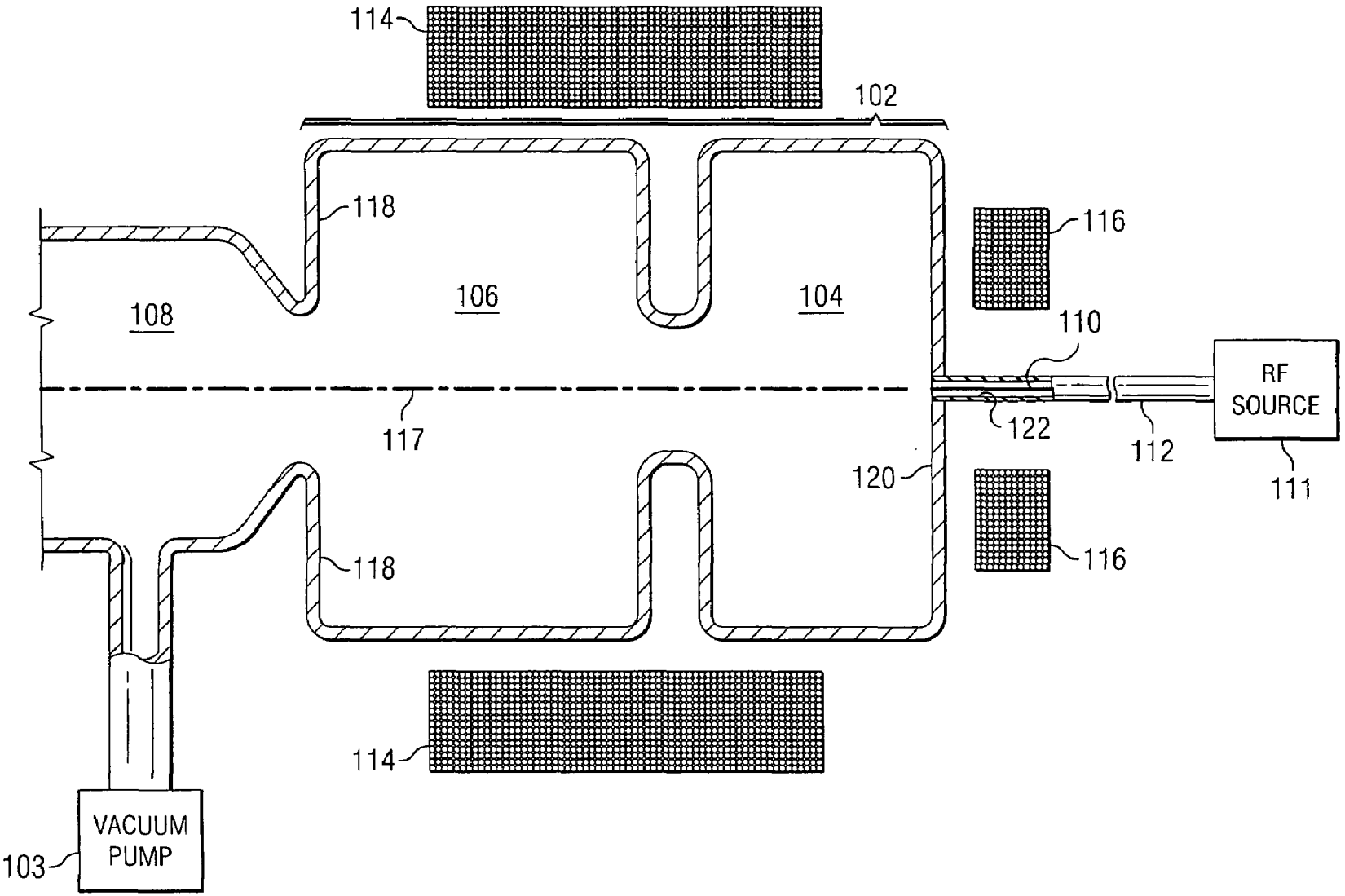
RF SOURCE
111
112
116
110
122
116
102
120
104
106
114
117
118
118
114
108
VACUUM PUMP
103

AXISYMMETRIC EMITTANCE-COMPENSATED ELECTRON GUN

TECHNICAL FIELD

This invention relates in general to RF electron guns, and more particularly to an axisymmetric emittance compensated electron gun.

BACKGROUND OF THE INVENTION

Electron guns generate and accelerate narrowly focused beams of electrons. In a radio frequency (RF) electron gun, the electrons are accelerated with RF energy. The transverse emittance of the electron beam refers to the electrons that travel in a direction other than along the axis of the beam. Because these electrons do not travel within the beam of the electron gun, the energy consumed in generating these electrons may be considered as wasted energy. Consequently, it is desirable to have an electron gun structure that minimizes transverse emittance.

BRIEF SUMMARY OF THE INVENTION

The present invention is directed to a system and method which substantially reduces or eliminates certain sources of emittance growth and allows more thorough optimization of emittance compenstation. In particular, certain embodiments of the electron gun of the present invention provides an architecture that permits easier placement of emittance-compensating solenoids and permits greater flexibility in cavity design.

In accordance with one embodiment of the present invention, an electron gun includes a cathode, a cavity and an energy input. The cavity resonates at a particular frequency, and the cathode generates an electron beam that is accelerated along the cavity's longitudinal axis when driven by resonant electromagnetic radiation of the particular frequency. The energy input introduces electromagnetic radiation of the particular frequency into the cavity.

In accordance with another embodiment of the present invention, an electron gun has a coaxial cable coupled to a cavity where the cavity resonates when electromagnetic radiation of a particular frequency is introduced into the cavity through the coaxial cable. A center conductor of the coaxial cable extends into the cavity and generates an electron beam along the longitudinal axis of the coaxial cable when driven by resonant electromagnetic radiation of the particular frequency. The coaxial cable introduces electromagnetic radiation of the particular frequency into the cavity along the longitudinal axis of the cable.

Important technical advantages of certain embodiments of the present invention include easier solenoid placement. The axisymmetric design of certain embodiments allows a cavity design without protrusions used to introduce RF energy. Thus, the solenoid's position may be adjusted without having to compensate for the presence of such protrusions.

Other important technical advantages of certain embodiments of the present invention include flexible cavity size. In certain embodiments, the cavity wall surrounding the electron filament may be adjusted to change the resonance of the cavity of the electron gun. These adjustments allow the electron gun to be tuned to a variety of frequencies depending on the intended use. Furthermore, because the position of the solenoid may also be adjusted in certain embodiments, the emittance compensation of the new configuration may be corrected for the new cavity size.

Other technical advantages of the present invention will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention, reference is now made to the following descriptions taken in conjunction with the accompanying drawing, in which:

FIG. 1 shows an electron gun in accordance with the present invention.

DETAILED DESCRIPTION OF THE INVENTION

FIG. 1 illustrates an electron gun 100 according to a particular embodiment of the present invention. Cavity 102 comprises one or more cells of conductive material enclosing volumes of space. In the particular embodiment depicted, cavity 102 is a one-and-a-half cell cavity that includes a half-cell 104 and one booster cell 106. However, it should be understood by one skilled in the art that the size and number of cells in the cavity may be selected to produce any desired resonance for a selected wavelength and power of RF input, and the depicted embodiment is only one example of cavity 102. Cavity 102 may be evacuated by vacuum pump 103 so that the electron beam is not scattered from air molecules within cavity 102.

Exit channel 108 provides a means for the electron beam to exit the electron gun 100. Exit channel 108 is typically circular with the radius of exit channel 108 aperture selected to minimize transverse non-linear fields.

Cathode 110, with longitudinal axis 117, may be a photocathode, thermionic cathode, or field emission cathode, or any other device that can emit electrons. The material of cathode 110 may be selected based on a wide variety of desired properties, including efficiency, durability, ease of replacement, or other suitable consideration. Cavity 102 is axisymmetric around longitudinal axis 117.

RF source 111 represents any suitable source of radio frequency radiation. RF source 111 may be a klystron, magnetron, or any other suitable device, whether tunable or not. RF source 111 may be positioned in any suitable or convenient location allowing RF energy from source 111 to enter energy input 112.

Energy input 112 represents any cable, conduit, waveguide, or other suitable medium for delivering RF energy from RF source 111 to cavity 102. In a particular embodiment, energy input 112 is a waveguide transitioned to a coaxial line 122, and cathode 110 represents an extension of the central conductor of coaxial line 122. The RF energy from energy input 112 travels into the cavity, and the resonance of the RF energy in cavity 102 produces strong electric fields. The electric fields accelerate the electrons from cathode 110, which then exit channel 108. By using a sufficient power level and a frequency tuned to the resonance frequency of cavity 102, the electrons may be accelerated relatively quickly, so that the repulsion produced by space charge effects is lessened. Because there is a finite acceleration time for the electrons, the electrons will phase lag slightly behind the resonant electric fields in the cavity.

A technical advantage of aligning energy input 112 longitudinally with cathode 110 is axial symmetry. Many conventional RF electron guns deliver RF energy using a rectangular waveguide directing the RF energy through a small hole in the wall of cavity 102. This creates a field asymmetry in the resonant electric field, which produces or enhances transverse emittance growth. The asymmetry in structural design also makes it more difficult to fabricate cavity 102, and may reduce the overall mechanical strength of cavity 102. Furthermore, it may be more difficult to position other components of gun 100, such as solenoid 114, as well as brackets or other apparatus for positioning and securing gun 100. Other advantages of axial symmetry include that computer models of gun 100 may be more accurate because the models do not need to take into account the asymmetric effects of protrusions, transverse RF radiation, and other complexities.

Solenoid 114 is a powered conductive coil that produces a magnetic focusing field within cavity 102. The strength of the magnetic field and the position of solenoid 114 may be adjusted to maximize the focusing effects of solenoid 114. The rapid acceleration produced by the electric field combined with the phase normalization of the magnetic field of solenoid 114 substantially reduces the amount of transverse emittance in the electron beam. Bucking coil 116 offsets the field of solenoid 114 at cathode 110 to allow the electrons to be emitted in zero magnetic field.

Particular embodiments of gun 100 allow cavity 102 to be tuned to different frequencies. In a particular embodiment, endwall 118 of cavity 102 may be deformed or otherwise adjusted in order to affect the size of booster cell 106. Similarly, cathode 110 may be repositioned slightly within half-cell 104 to affect the overall resonance of cavity 102. For example, if cathode 110 is the center conductor of a coaxial line 122, a connector 120 couples coax 122 to cavity 102. By moving the center conductor of coax 122 in or out using connector 120, the position of cathode 110 is precisely adjusted. By performing such adjustments, the resonant frequency of cavity 102 may be changed to match other system components.

Although the present invention has been described with several embodiments, a myriad of changes, variations, alterations, transformations, and modifications may be suggested to one skilled in the art. In particular, the described techniques are adaptable to a wide variety of cathode materials, cavity configurations, solenoid designs, energy inputs, energy sources, resonant frequencies, and various other design choices. It is intended that the present invention encompass such changes, variations, alterations, transformations, and modifications as fall within the scope of the appended claims.

Although the present invention has been described in detail, it should be understood that various changes, substitutions and alterations can be made herein without departing from the invention as defined by the appended claims. Moreover, the scope of the present invention is not intended to be limited to the particular embodiments described in the specification. As one of ordinary skill in the art will readily appreciate from the foregoing disclosure, alternatives presently existing or later to be developed that perform substantially the same function or achieve substantially the same result as the corresponding embodiments described herein may be utilized in accordance with the present invention.

What is claimed is:

1. An electron gun, comprising:

a cathode having a longitudinal axis and operable to generate an electron beam on the longitudinal axis when driven by resonant electromagnetic radiation of a particular frequency;

a cavity surrounding the cathode and operable to resonate when electromagnetic radiation of the particular frequency is introduced into the cavity; and an energy input coupled to the cavity and operable to introduce electromagnetic radiation of the particular frequency into the cavity along the longitudinal axis of the cathode.

2. The electron gun of claim 1, wherein the cavity is axisymmetric around the longitudinal axis.

3. The electron gun of claim 1, wherein:

the electron gun further comprises a solenoid disposed around the cavity and operable to produce a magnetic field that reduces transverse emittance of the electron beam; and the solenoid is operable to be positioned at any point along the length of the cavity in order to adjust the amount of reduction of the transverse emittance of the electron beam.

4. The electron gun of claim 1, wherein the cavity comprises:

one or more booster cells; and an exit channel.

5. The electron gun of claim 1, wherein:

the energy input comprises a coaxial line having a center conductor; and the cathode comprises an extension of the center conductor of the coaxial cable.

6. The electron gun of claim 5, wherein:

the cathode is operable to be selectively positioned in the cavity so that changing the position of the cathode in the cavity changes the particular frequency at which the cavity resonates.

7. The electron gun of claim 6, wherein the cathode is selectively positioned by a connector coupling the coaxial cable to the cavity.

8. The electron gun of claim 1, wherein the cavity comprises an endwall operable to be selectively deformed to change the particular frequency at which the cavity resonates.

9. An electron gun, comprising:

a cavity operable to resonate when electromagnetic radiation of a particular frequency is introduced into the cavity; and a coaxial line coupled to the cavity having a center conductor that extends into the cavity, the center conductor operable to produce an electron beam along a longitudinal axis of the coaxial cable when driven by resonant electromagnetic radiation of the particular frequency, wherein the coaxial line is operable to introduce electromagnetic radiation of the particular frequency into the cavity along the longitudinal axis of the coaxial cable.

10. The electron gun of claim 9, wherein the cavity is axisymmetric around the longitudinal axis.

11. The electron gun of claim 9, wherein:

the electron gun further comprises a solenoid disposed around the cavity and operable to produce a magnetic field that reduces transverse emittance of the electron beam; and the solenoid is operable to be positioned at any point along the length of the cavity in order to adjust the amount of reduction of the transverse emittance of the electron beam.

12. The electron gun of claim 9, wherein the coaxial line is operable to be selectively positioned to change the particular frequency at which the cavity resonates.

13. The electron gun of claim 12, wherein:

the coaxial line further comprises a threaded connector coupling the coaxial line to the cavity; and the coaxial line is positioned by adjusting the threaded connector.

14. The electron gun of claim 9, wherein the cavity comprises an endwall operable to be selectively deformed to change the particular frequency at which the cavity resonates.

15. A method of generating an electron beam, comprising:

providing a cavity operable to resonate when electromagnetic radiation of a particular frequency is introduced into the cavity;

providing a cathode within the cavity operable to generate an electron beam on a longitudinal axis when being driven by resonant electromagnetic radiation of the particular frequency; and introducing electromagnetic radiation of the particular frequency into the cavity along the longitudinal axis of the cathode.

16. The method of claim 15, further comprising:

selectively adjusting the particular frequency at which the cavity resonates by repositioning the cathode; and introducing electromagnetic radiation of the new resonant frequency into the cavity along the longitudinal axis of the cathode.

17. The method of claim 16, further comprising:

reducing transverse emittance of the electron beam by disposing a solenoid around the cavity.

18. The method of claim 15, further comprising:

adjusting the particular frequency at which the cavity resonates by selectively deforming an endwall of the cavity; and introducing electromagnetic radiation of the new resonant frequency into the cavity along the longitudinal axis of the cathode.

19. The method of claim 15, wherein:

the electromagnetic radiation is introduced into the cavity by a coaxial line coupled to the cavity; and the cathode comprises an extension of a center conductor of the coaxial cable.

* * * * *